US007980895B2

(12) United States Patent
Berens et al.

(10) Patent No.: US 7,980,895 B2
(45) Date of Patent: Jul. 19, 2011

(54) ELECTRICAL CONNECTOR AND MANUFACTURING METHOD THEREOF

(75) Inventors: Luc Berens, Drunnen (NL); Fred Scheefhals, Boxtel (NL); Ton Van Der Bruggen, Vught (NL); Randy Van Hoof, Oss (NL)

(73) Assignee: Tyco Electronics Nederland BV, Hertogenbosch (NL)

( * ) Notice: Subject to any disclaimer, the term of this patent is extended or adjusted under 35 U.S.C. 154(b) by 0 days.

(21) Appl. No.: 12/605,917

(22) Filed: Oct. 26, 2009

(65) Prior Publication Data

US 2010/0112867 A1 May 6, 2010

Related U.S. Application Data

(63) Continuation of application No. PCT/EP2008/002170, filed on Mar. 18, 2008.

(30) Foreign Application Priority Data

Apr. 27, 2007 (EP) ..... 07008711

(51) Int. Cl.
*H01R 13/648* (2006.01)
*H01R 13/405* (2006.01)

(52) U.S. Cl. ..... 439/607.05; 439/626; 439/606; 439/736; 29/883

(58) Field of Classification Search ..... 439/606, 439/626, 736, 607.5; 28/883
See application file for complete search history.

(56) References Cited

U.S. PATENT DOCUMENTS

| | | | | |
|---|---|---|---|---|
| 4,842,525 | A | 6/1989 | Galloway et al. | |
| 5,060,372 | A * | 10/1991 | Capp et al. | 29/883 |
| 5,066,236 | A | 11/1991 | Broeksteeg | |
| 5,145,413 | A * | 9/1992 | Okamoto et al. | 439/620.14 |
| 5,359,761 | A * | 11/1994 | Whitson et al. | 29/883 |
| 6,657,287 | B2 * | 12/2003 | Smith et al. | 257/666 |
| 7,347,740 | B2 * | 3/2008 | Minich | 439/736 |
| 7,431,616 | B2 * | 10/2008 | Minich | 439/607.05 |
| 7,503,112 | B2 * | 3/2009 | Ice et al. | 29/883 |
| 7,581,993 | B1 * | 9/2009 | Lai et al. | 439/687 |
| 2003/0025788 | A1 | 2/2003 | Beardsley | |
| 2007/0218765 | A1 * | 9/2007 | Cohen et al. | 439/608 |

OTHER PUBLICATIONS

PCT International Preliminary Report on Patentability cited in co-pending application PCT/EP2008/002170, dated Oct. 27, 2009, 1 page.
PCT Written Opinion of the ISA cited in co-pending application PCT/EP2008/002170, dated Oct. 27, 2009, 5 pages.

(Continued)

*Primary Examiner* — Briggitte R Hammond
(74) *Attorney, Agent, or Firm* — Barley Snyder LLC

(57) ABSTRACT

A method for manufacturing an electrical contact module is provided. First, a lead-frame of electrical conductors is formed, wherein at least one supporting strip is formed in the lead-frame of electrical conductors in such a way as to maintain the electrical conductors in a predetermined position with respect to each other. Then, the lead-frame of electrical conductors is over-molded with a first dielectric material, thereby obtaining a first over-molded lead-frame. At least one aperture is formed in the first over-molded lead-frame so that the at least one supporting strip is accessible. The at least one supporting strip in the first over-molded lead-frame is removed after completion of the over-molding step. A second dielectric material is then over-molded with the first over-molded lead-frame in such manner as to fill the at least one aperture and a space left between the electrical conductors after removal of the at least one supporting strip.

22 Claims, 6 Drawing Sheets

OTHER PUBLICATIONS

PCT International Search Report cited in co-pending application PCT/EP2008/002170, dated Apr. 24, 2008, 2 pages.

EP Search Report cited in co-pending application EP 07008711, dated Oct. 22, 2007, 2 pages.

EP Search Opinion cited in co-pending application EP 07008711, dated Oct. 22, 2007, 2 pages.

EP Communication pursuant to Article 94(3) EPC cited in co-pending application EP07008711, dated May 27, 2009, 1 page.

* cited by examiner

ELECTRICAL CONNECTOR AND MANUFACTURING METHOD THEREOF

CROSS-REFERENCE TO RELATED APPLICATIONS

This application is a continuation of PCT International Application No. PCT/EP2008/002170, filed Mar. 18, 2008, which claims priority under 35 U.S.C. §119 to European Patent Application No. EP07008711.9, filed Apr. 27, 2007.

FIELD OF INVENTION

The present invention relates to an electrical connector and in particular to a method for manufacturing same.

BACKGROUND

With the ongoing trend towards smaller, faster and higher performance electrical components, such as a processor used in computers, routers, switches, etc., it has become increasingly important for the electrical interfaces along the electrical path to also operate at higher frequencies and at higher densities with increased throughput.

In a traditional approach for interconnecting circuit boards, one circuit board serves as a backplane and the other as a daughter board. The backplane typically has a connector, commonly referred to as a header that includes a plurality of signal pins or contacts, which connect to conductive traces on the backplane. The daughter board connector, commonly referred to as a receptacle, also includes a plurality of contacts or pins. Typically, the receptacle is a right angle connector that interconnects the backplane with the daughter board so that signals can be routed between the two. The right angle connector typically includes a mating face that receives the plurality of signal pins from the header on the backplane and a mounting face that connect to the daughter board. Likewise, the header includes a mating face adapted to mate with the mating face of the right angle connector and a mounting face that connects to the backplane board.

As the transmission frequencies of signals through these connectors increase, it becomes more desirable to maintain a desired impedance through the connector to minimize signal degradation. A ground shield is sometimes provided on the module to reduce interference or crosstalk. In addition, a ground shield may be added to the ground contacts on the header connector. Improving connector performance and increasing contact density to increase signal carrying capacity without increasing the size of the connectors is challenging.

Some older connectors, which are still in use today, operate at speeds of one gigabit per second or less. In contrast, many of today's high performance connectors are capable of operating at speeds of up to 10 gigabits or more per second. As would be expected, the higher performance connector also comes with a higher cost.

When trying to design an electrical connector having a reduced pitch between signal pins, so as to obtain an electrical connector with a reduced size or with an increased pin density, the signal pins are made thinner and are therefore more fragile and likely to be bent or broken. When these electrical connectors are implemented in high-speed applications involving high transmission data rates, it is crucial to guarantee a high degree of electrical performance. However, the impedance and other important electrical properties of an electrical connector are dependent on the geometrical arrangement of the signal pins with respect to one another.

Hence, it is challenging to design an electrical connector having a smaller pitch between its contacts, while guaranteeing high electrical performance.

Another problem, which might occur in electrical connectors, is that the contacts in the housing of the electrical connector, in particular the resilient parts that are located at the end of the electrical contacts, may be inaccurately positioned. This inaccurate positioning is considered a failure mechanism according to the electrical connector qualification tests used for telecommunication connectors such as Telcordia GR-1217-Core in the American market. This inaccurate positioning of the resilient part of the electrical contacts within one electrical connector can occur during production, handling, insertion, board handling, mating, etc. Furthermore, interferences may result that cause deviations from the contact normal force that has been originally designed. Moreover, the contact normal force may also decay with time due to stress relaxation or deformations of the resilient parts of the electrical contacts or deformations of the plastic connector parts of the housing. If the contact normal force is reduced to low levels, any additional decrease could be unacceptable and the contact normal force may reach critical minimum values.

In a high-speed connector, which supports high data rates and high frequencies, the design of the dielectric material surrounding the electrical conductors is crucial. Indeed, in order to enable constant electrical properties along the path of signals carried by the electrical conductors in the electrical connector, the dielectric properties of the material surrounding the electrical conductors should be as continuous as possible, and irregularities within the dielectric material should be avoided. In particular, introducing cavities in the over-molded material, which are filled with air, that has different electrical properties than the over-molded material itself, should be avoided as they introduce differences in the electrical characteristics within the dielectric material, thereby introducing irregularities within the electrical path of a signal, and therefore decreasing the electrical performance of the electrical connector.

SUMMARY

An object of the invention is to provide a method for manufacturing an electrical contact module and a method for assembling an electrical connector, which provides an electrical connector having improved electrical characteristics.

The method for assembling an electrical connector involves the step of manufacturing a plurality of electrical contact modules having a lead-frame of electrical conductors, at least one supporting strip formed in the lead-frame of electrical conductors, each electrical conductors positioned in a predetermined position with respect to each other by each supporting strip, a first over-molded lead-frame prepared from a over-molded first dielectric material and positioned over the lead-frame of electrical conductors, at least one aperture formed in the first over-molded lead-frame, the at least one aperture configured to access the at least one supporting strip for removal, and a second dielectric material filling the at least one aperture and a space left between the electrical conductors after removal of the at least one supporting strip. The method for assembling an electrical connector also involves the manufacturing an electrical connector housing, and then inserting a plurality of the electrical contact modules into the electrical connector housing.

BRIEF DESCRIPTION OF THE DRAWINGS

The present invention will be described in detail in the following based on the figures enclosed with the application.

DETAILED DESCRIPTION OF THE EMBODIMENT(S)

Figure 1:
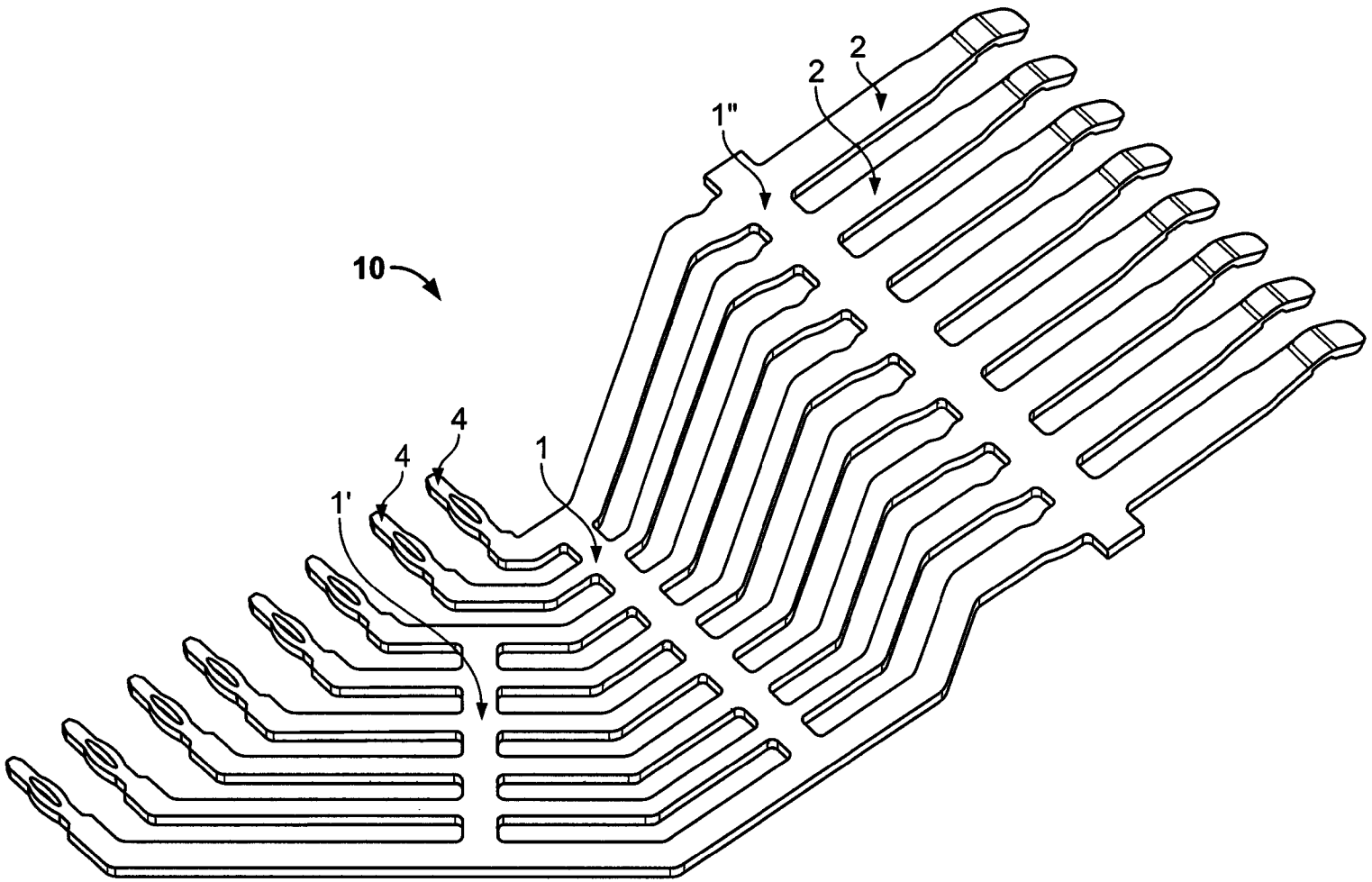
FIG. 1 is a perspective view of a lead-frame of electrical conductors according to an embodiment of the invention.

For an improved understanding of the present invention, the invention will now be described in more detail with the aid of the embodiments shown in the following figures. In this case, in the differently described embodiments, the same components will be provided with the same reference numerals and the same component designations, it being possible to accordingly transfer the disclosures contained in the entire description to the same components with the same reference numerals or component designations. Furthermore, some features or feature combinations of the shown and described different embodiments may also per se be solutions which are independent, inventive or in accordance with the invention.

FIG. 1, according to an embodiment of the invention, shows a lead-frame 10 having a plurality of electrical conductors, wherein each electrical conductor includes a mating contact 2 and a mounting contact 4, which are respectively arranged at the respective ends of each electrical conductor. The plurality of mating contacts 2 of the electrical conductors of the lead-frame 10 define a mating edge and the plurality of mounting contacts 4 of the electrical conductors define a mounting edge.

A first supporting strip 1 is formed in the lead-frame 10 of electrical conductors in such a way as to hold the electrical conductors in a certain position with respect to each other. The supporting strip 1 is formed as a part of the lead-frame 10 of electrical conductors, preferentially as a strip made out of the same conductive material as that used to form the lead-frame 10 of electrical conductors. The first supporting strip 1 is formed as a strip that connects the electrical conductors to each other.

As shown in FIG. 1, a second supporting strip 1' is formed in the lead-frame 10, wherein the second supporting strip 1' is arranged in the portion of the lead-frame 10 of electrical conductors comprised between the mounting edge and the first supporting strip 1. The second supporting strip 1' also allows the lead-frame 10 to maintain the electrical conductors in a predetermined position with respect to each other.

Even though FIG. 1 represents the particular case where two supporting strips 1, 1' are formed in the lead-frame 10 of electrical conductors, in order to maintain the electrical conductors in a certain position with respect to each other, it is also possible to use only a single supporting strip in the lead-frame 10 of electrical conductors. However, the mechanical stability of the lead-frame 10 of electrical conductors can be enhanced when using two supporting strips 1, 1'. The supporting strips 1, 1' provide the advantage of maintaining the lead-frame 10 of electrical conductors in a predetermined position during an over-molding of the lead-frame 10 of electrical conductors.

Furthermore, as also shown in FIG. 1, a third supporting strip 1" is formed in the lead-frame 10 of electrical conductors at the mating side of the lead-frame 10. This additional supporting strip 1" allows the lead-frame 10 to maintain the mating contacts 2 in a predetermined position with respect to each other during over-molding of the lead-frame 10.

Figure 2:
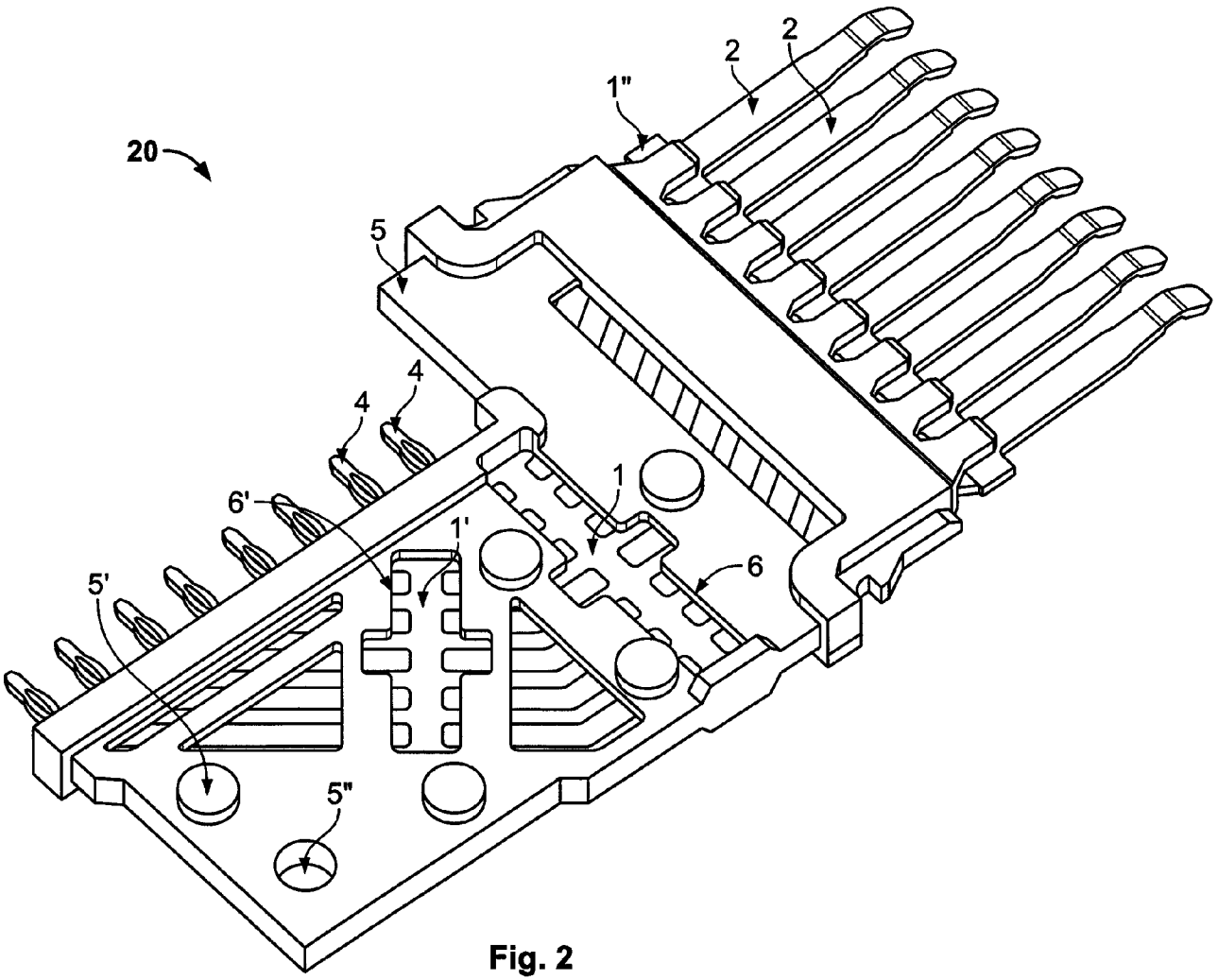
FIG. 2 is a perspective view of a first over-molded lead-frame of electrical conductors upon completion of a first over-molding step.

FIG. 2 represents the subsequent step of the method for manufacturing an electrical contact module according to the invention.

The electrical conductors of the lead-frame 10 are maintained in a predetermined position with respect to each other by the supporting strips 1, 1', 1" during a first over-molding step, during which the lead-frame 10 of electrical conductors is over-molded with a first dielectric material 5. The lead-frame 10 of electrical conductors is over-molded with the first dielectric material 5 in such a way that the mounting contacts 4 protrude out of the over-mold. Accordingly, the mounting contacts 2 protrude out of the over-mold in a similar way.

A first aperture 6 is formed in the over-molded dielectric material 5, so that the first supporting strip 1 formed in the lead-frame 10 of electrical conductors is accessible for being removed at a later stage, in order to electrically insulate the electrical conductors from each other. A second aperture 6' is also formed in the over-molded dielectric material 5, so as to render the second supporting strip 1' accessible for being removed at a later stage, in order to electrically insulate the electrical conductors from each other. The method used to remove the first and second supporting strips 1, 1' will be explained in the following paragraphs.

Even though a plurality of apertures 6, 6' is represented in FIG. 2, it may also be considered, as already mentioned above, that only one supporting strip supports the lead-frame 10 of electrical conductors, in which case a single aperture 6 would be formed in the over-molded lead-frame 20.

The lead-frame 10 of electrical conductors is over-molded with a dielectric material 5, which is preferentially made out of a liquid crystal polymer, which can be easily over-molded, and provides outstanding mechanical properties at high temperatures, as well as excellent chemical resistance, while being relatively cheap.

The over-mold out of dielectric material 5 may also comprise one or a plurality of protrusions 5' as well as one or a plurality of cavities 5", which allow for connecting thereto a second over-mold made out of a second dielectric material (not shown), which will be arranged on the first over-molded lead-frame 20 in a second over-molding step, which will be explained in the following.

Figure 3:
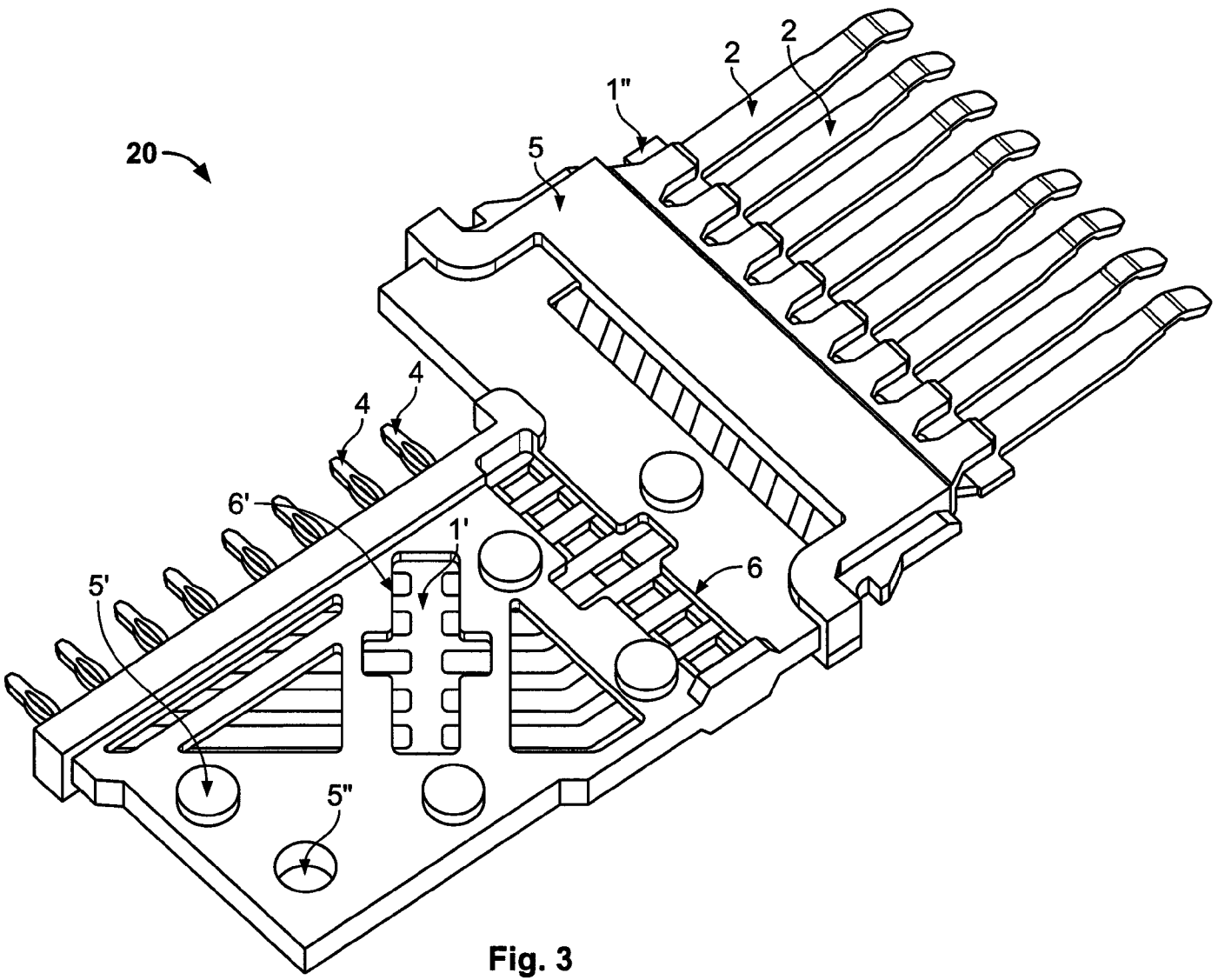
FIG. 3 is a perspective view of the first over-molded lead-frame of electrical conductors shown in FIG. 2 after removal of a first supporting strip from the lead-frame of electrical conductors.

FIG. 3 shows a perspective view of the over-molded lead-frame 20 shown in FIG. 2, wherein the first supporting strip 1 is removed from the over-molded lead-frame 20 after completion of the first over-molding step. The removal of the supporting strip 1 includes the step of cutting away the connection points connecting the electrical conductors to each other, thereby electrically insulating the electrical connectors from each other. During this removal step, the conductive material, formed between the electrical conductors, is removed. This therefore leaves a hole in the remaining dielectric material that has been over-molded in the space between the electrical conductors during the first over-molding step.

Figure 4:
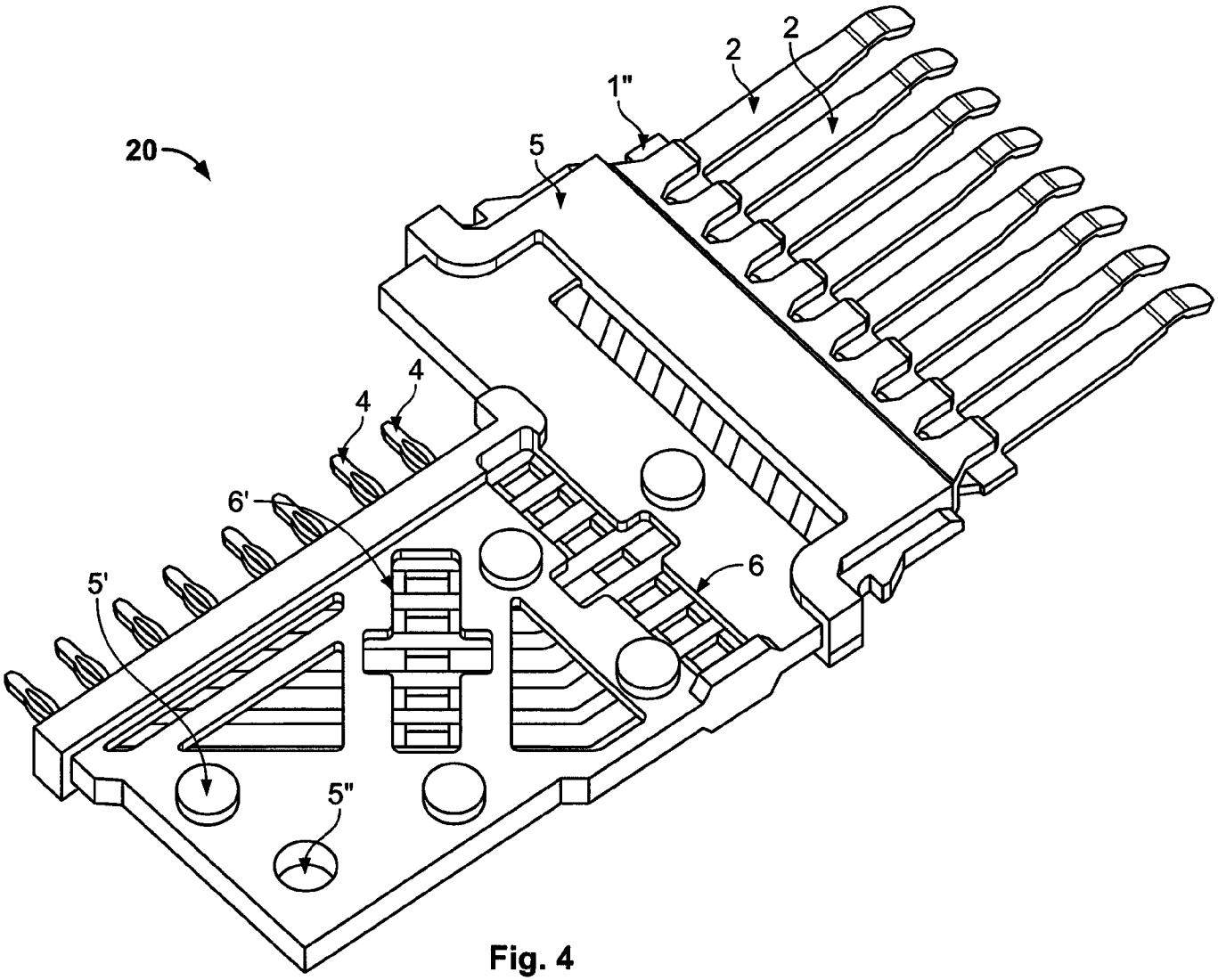
FIG. 4 is a perspective view of the first over-molded lead-frame of electrical conductors shown in FIG. 3 after a further step of removal of a second supporting strip from the lead-frame of electrical conductors.

FIG. 4 shows a perspective view of the over-molded lead-frame 20 shown in FIG. 3, wherein the first supporting strip 1' is removed from the over-molded lead-frame 20 after completion of the first over-molding step. The removal of the supporting strip 1' includes the step of cutting away the connection points connecting the electrical conductors to each other, thereby electrically insulating the electrical connectors from each other. During this removal step, the conductive material, formed between the electrical conductors, is removed. This therefore leaves a hole in the remaining dielectric material that has been over-molded in the space between the electrical conductors during the first over-molding step.

Figure 5:
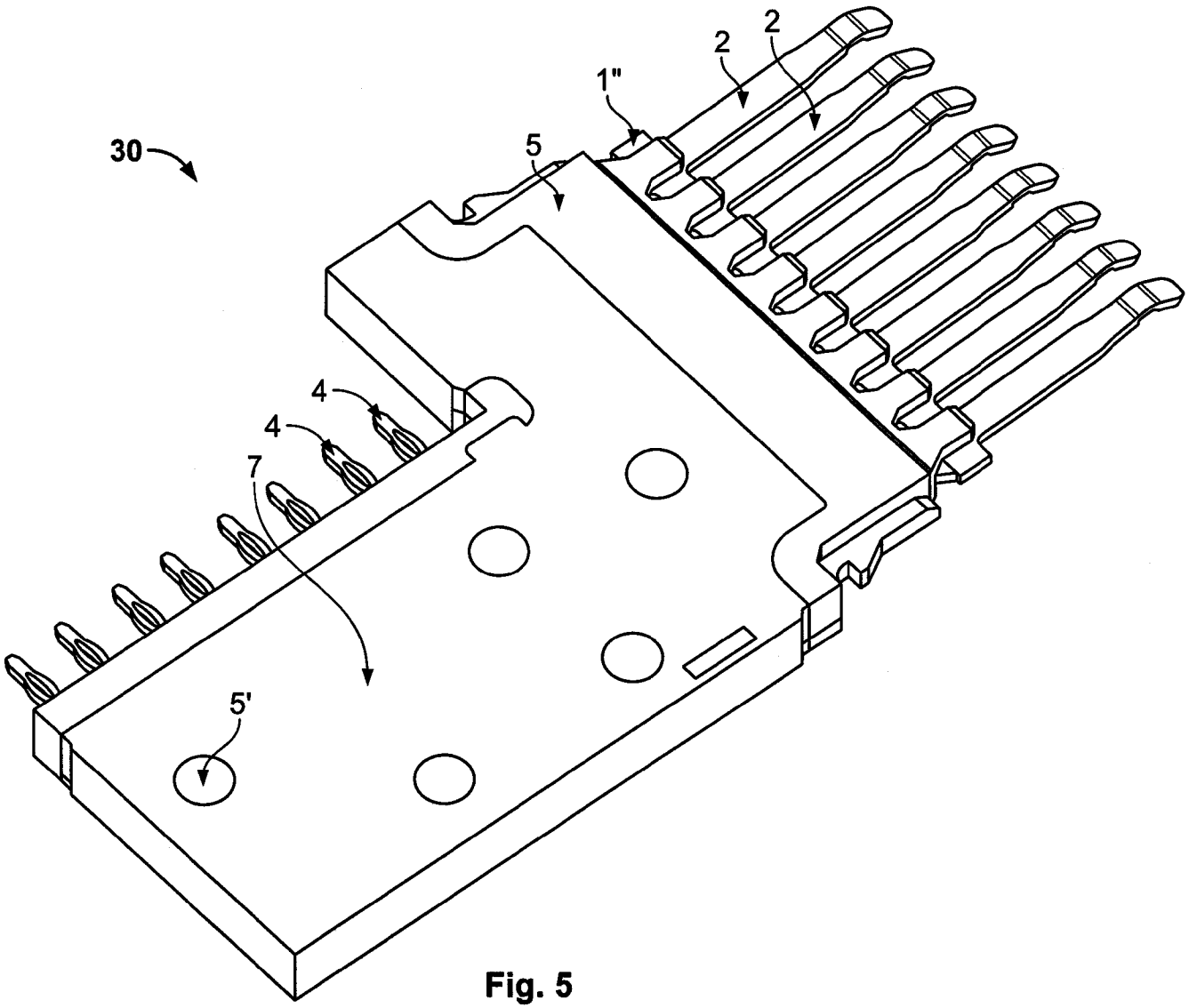
FIG. 5 is a perspective view of the first over-molded lead-frame of electrical conductors shown in FIG. 4 after a second over-molding step.

FIG. 5 shows a perspective view of the over-molded lead-frame 20 of FIG. 4 after a second over-molding step, thereby forming an electrical contact module 30.

After removal of the supporting strips 1, 1' connecting the electrical conductors of the lead-frame 10 to each other, a second over-molding step is performed, wherein the first over-molded lead-frame 20 is over-molded with a second dielectric material 7.

The first aperture 6 and second aperture 6', formed in the over-mold and made out of the first dielectric material 5, are filled during the second over-molding step with the second dielectric material 7, in order to prevent cavities filled with air surrounding the electrical conductors of the lead-frame 10. The space, left between the electrical conductors after removal of the respective supporting strips 1, 1', is filled with the second dielectric material 7, thereby avoiding discontinuities in the dielectric material surrounding the electrical conductors of the lead-frame 10.

The second dielectric material 7 can be as a dielectric material identical to the first dielectric material 5, or, alternatively, as a dielectric material different from the first dielectric material 5, and having a melting point that is lower than the melting point of the first dielectric material 5.

When the first over-molded lead-frame 20 includes protrusions 5' and cavities 5", the over-mold, made out of the second dielectric material 7, includes corresponding cavities and protrusions, respectively, in order to connect the over-mold made out of the second dielectric material 7 with the first over-molded lead-frame 20 more easily.

Figure 6:
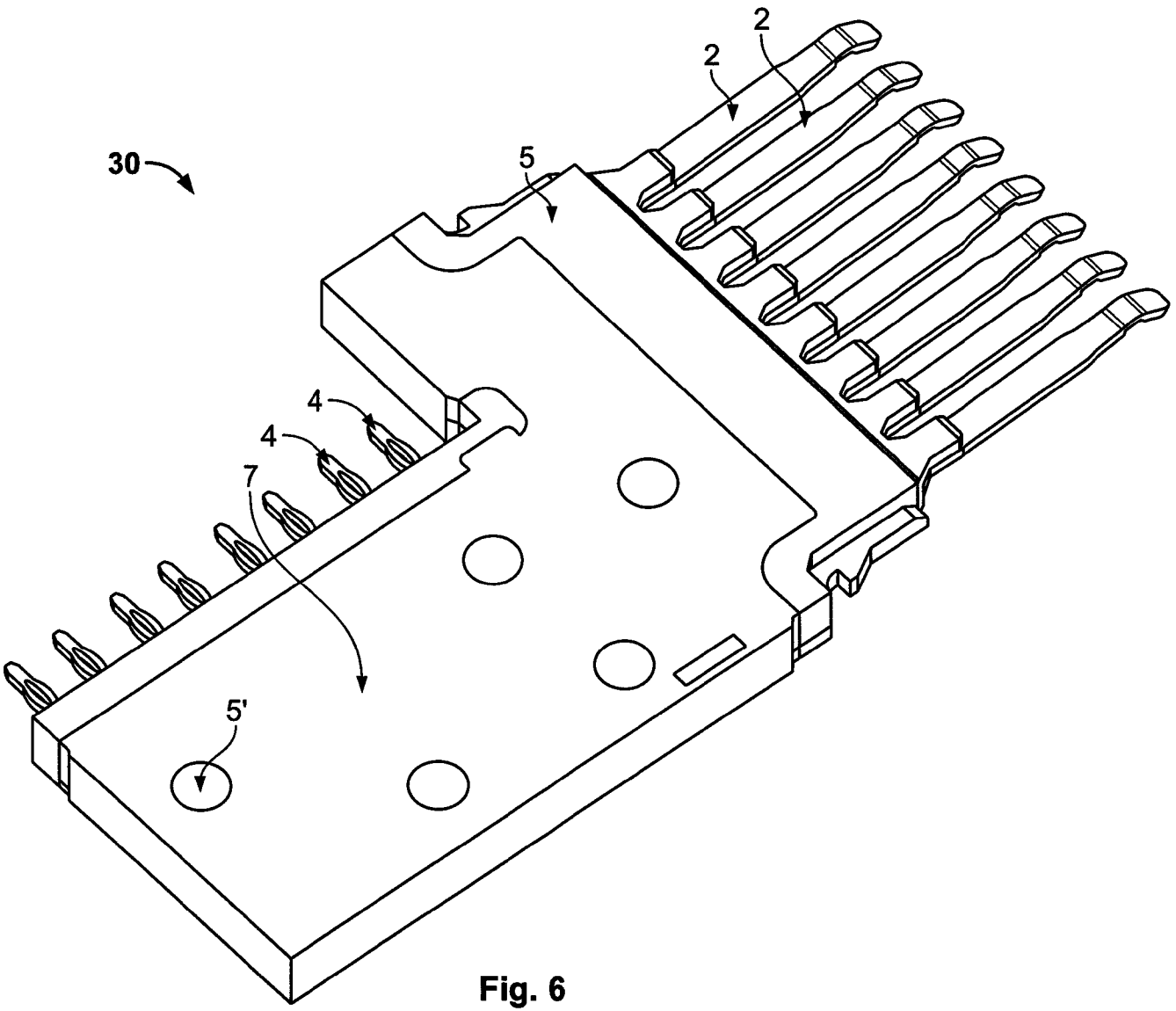
FIG. 6 is a perspective view of a finished electrical contact module after a removal of a third supporting strip arranged at the mating side of the electrical contact module.

FIG. 6 shows a perspective view of a finished electrical contact module 30 after a final step of removing the third supporting strip 1" between the mating contacts. The connection points between the electrical connectors at the mating edge are cut away, thereby electrical insulating the mating contacts 2 from each.

According to another embodiment of the invention, a method for assembling an electrical connector is provided, wherein a plurality of electrical contact modules 30 are inserted into an electrical connector housing (not shown). An electrical contact module 30 is also referred to in the art as a "chicklet", a plurality of which may be positioned in an electrical connector housing, thereby providing an electrical connector.

Since the second dielectric material 7 is over-molded on the first over-molded lead-frame 20 in such a way as to avoid any cavities filled with air from being present in the electrical contact module 30, high electrical performance of the electrical connector is achieved.

While the embodiments of the present invention have been illustrated in detail, it should be apparent that modifications and adaptations to those embodiments may occur.

The invention claimed is:

1. A method for manufacturing an electrical contact module comprising the steps of:

forming a lead-frame of electrical conductors, wherein at least one supporting strip is formed in the lead-frame, each electrical conductor positioned in a predetermined position with respect to each other by the supporting strip;

over-molding the lead-frame with a first dielectric material to form a first over-molded lead-frame, wherein at least one aperture is formed in the first over-molded lead-frame so that the at least one supporting strip is accessible;

removing the at least one supporting strip after completion of the first over-molding step; and over-molding the first over-molded lead-frame with a second dielectric material to fill the at least one aperture and a space left between the electrical conductors by removal of the at least one supporting strip.

2. The method according to claim 1, wherein the supporting strip is formed from same conductive material as that used to form the lead-frame of electrical conductors.

3. The method according to claim 1, wherein the supporting strip connects the electrical conductors with each other.

4. The method according to claim 2, further comprising the step of cutting away connection points between the electrical conductors to electrically insulate the electrical conductors from each other.

5. The method according to claim 1, further comprising the step of forming two supporting strips in the lead-frame.

6. The method according to claim 5, further comprising step of forming two corresponding apertures in the first over-molded lead-frame.

7. The method according to claim 4, further comprising the step of forming two supporting strips in the lead-frame.

8. The method according to claim 7, further comprising the step of forming two corresponding apertures in the first over-molded lead-frame.

9. The method according to claim 1, further comprising the step of forming a second supporting strip in the lead-frame of electrical conductors at a mating side of the electrical conductors, the second supporting strip being structurally different from the at least one supporting strip.

10. The method according to claim 9, further comprising the step of removing the second supporting strip after completion of the second over-molding step in order to electrically isolate the mating contacts from each other.

11. The method according to claim 1, further comprising the step of over-molding the first over-molded lead-frame with a second dielectric material that is identical to the first dielectric material.

12. The method according to claim 10, further comprising the step of over-molding the first over-molded lead-frame with a second dielectric material that is identical to the first dielectric material.

13. The method according to claim 1, further comprising the step of over-molding the first over-molded lead-frame with a second dielectric material, the second dielectric material being compositionally different from the first dielectric material.

14. The method according to claim 13, wherein the second dielectric material has a lower melting point than that of the first dielectric material.

15. An electrical contact module comprising:

a lead-frame of electrical conductors;

at least one supporting strip formed in the lead-frame, each electrical conductor positioned in a predetermined position with respect to each other by the supporting strip;

a first over-molded material positioned over the lead-frame;

at least one aperture formed in the first over-molded material, the at least one aperture configured to access the at least one supporting strip for removal; and a second dielectric material filling the at least one aperture and a space left between the electrical conductors by removal of the at least one supporting strip.

16. The electrical contact module according to claim 15, wherein the supporting strip is formed from same conductive material as that of the lead-frame.

17. The electrical contact module according to claim 15, further comprising two supporting strips formed in the lead-frame.

18. The electrical contact module according to claim 17, further comprising two corresponding apertures formed in the first over-molded material in order to access the two supporting strips for removal.

19. The electrical contact module according to claim 15, further comprising a second supporting strip formed in the lead-frame at a mating side of the electrical conductors, the second supporting strip being structurally different from the at least one supporting strip.

20. The electrical contact module according to claim 15, further comprising a second dielectric material over-molded over the first over-molded material.

21. An electrical connector comprising:

a plurality of electrical contact modules comprising:

a lead-frame of electrical conductors at least one supporting strip formed in the lead-frame of electrical conductors, each electrical conductor positioned in a predetermined position with respect to each other by each supporting strip;

a first over-molded lead-frame formed of a first dielectric over-molded material positioned over the lead-frame;

at least one aperture formed in the first over-molded lead-frame, the at least one aperture configured to access the at least one supporting strip for removal;

a second dielectric material filling the at least one aperture and a space left between the electrical conductors after removal of the at least one supporting strip; and an electrical connector housing, wherein the plurality of electrical contact modules are inserted into the electrical connector housing.

22. A method for assembling an electrical connector, the method comprising:

manufacturing a plurality of electrical contact modules comprising:

a lead-frame of electrical conductors at least one supporting strip formed in the lead-frame, each electrical conductor positioned in a predetermined position with respect to each other by each supporting strip;

a first over-molded lead-frame prepared from an over-molded first dielectric material and positioned over the lead-frame of electrical conductors;

at least one aperture formed in the first over-molded lead-frame, the at least one aperture configured to access the at least one supporting strip for removal;

a second dielectric material filling the at least one aperture and a space left between the electrical conductors after removal of the at least one supporting strip;

manufacturing an electrical connector housing; and inserting the plurality of the electrical contact modules into the electrical connector housing.

* * * * *